US009406428B2

(12) United States Patent
Takeda

(10) Patent No.: US 9,406,428 B2
(45) Date of Patent: Aug. 2, 2016

(54) INDUCTOR

(71) Applicant: MURATA MANUFACTURING CO., LTD., Kyoto-fu (JP)

(72) Inventor: Yasushi Takeda, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/607,396

(22) Filed: Jan. 28, 2015

(65) Prior Publication Data

US 2015/0228396 A1 Aug. 13, 2015

(30) Foreign Application Priority Data

Feb. 10, 2014 (JP) ..... 2014-023055

(51) Int. Cl.
*H01F 5/00* (2006.01)
*H01F 17/00* (2006.01)

(52) U.S. Cl.
CPC ..... *H01F 17/0033* (2013.01); *H01F 17/0013* (2013.01)

(58) Field of Classification Search
CPC ..... H01F 27/2804; H01F 27/34; H01F 2027/2809; H01F 17/0033; H01F 17/0013
USPC ..... 336/200, 223, 233
See application file for complete search history.

(56) References Cited

U.S. PATENT DOCUMENTS

2004/0141297 A1* 7/2004 Tokuda ..... H01F 17/0013 361/762
2004/0207488 A1* 10/2004 Kono ..... C03C 3/085 333/185
2009/0102591 A1 4/2009 Gotsch et al.

FOREIGN PATENT DOCUMENTS

JP 2006-339532 A 12/2006
JP 2007-317892 A 12/2007
JP 2009-537976 A 10/2009
JP 2014-082358 A 5/2014

OTHER PUBLICATIONS

An Office Action; "Notice of Reasons for Rejection," issued by the Japanese Patent Office on Jan. 5, 2016, which corresponds to Japanese Patent Application No. 2014-023055 and is related to U.S. Appl. No. 14/607,396.

* cited by examiner

*Primary Examiner* — Mangtin Lian
(74) *Attorney, Agent, or Firm* — Studebaker & Brackett PC

(57) ABSTRACT

An inductor includes a multilayer body, which is composed of a non-magnetic material and a magnetic material, and a coil. An inner circumferential surface of the coil is covered by non-magnetic material layers. The sum of the width of a coil conductor forming part of the coil and the width of a non-magnetic material layer covering an inner circumferential side of the coil conductor that are located in a center portion of the coil in a z-axis direction is larger than the sum of the width of a coil conductor forming part of the coil and the width of a non-magnetic material layer covering the coil conductor that are located in an end portion of the coil on the positive side in the z-axis direction.

11 Claims, 14 Drawing Sheets

INDUCTOR

CROSS REFERENCE TO RELATED APPLICATIONS

This application claims benefit of priority to Japanese Patent Application No. 2014-023055 filed Feb. 10, 2014, the entire content of which is incorporated herein by reference.

TECHNICAL FIELD

The present technical field relates to inductors and in particular relates to an inductor that includes a magnetic material and a non-magnetic material.

BACKGROUND

The multilayer inductor described in Japanese Unexamined Patent Application Publication No. 2007-317892 is a known example of an inductor of the related art. In this type of inductor (hereafter referred to as inductor of the related art), a coil is built into a multilayer body formed by stacking a plurality of insulator layers on top of one another. The coil is formed of a plurality of coil conductors and via conductors and has a substantially helical shape. When a current flows through the inductor of the related art, lines of magnetic force are concentrated around corners of the coil conductors located in end portions of the coil and magnetic saturation is liable to occur. As a result, a problem occurs in that the alternating current resistance is high.

SUMMARY

Accordingly, an object of the present disclosure is to provide an inductor that includes a magnetic material and a non-magnetic material and that is capable of suppressing an increase in alternating current resistance.

An inductor according to an embodiment of the present disclosure includes a body composed of a non-magnetic material and a magnetic material; and a helical-shaped coil located inside the body; an inner circumferential surface of the coil being covered by the non-magnetic material. In an orthogonal direction that is orthogonal to a central axis direction, which is a direction in which a central axis of the coil extends, and that is orthogonal to an advancement direction of a conductor that forms the coil, a sum of a width of the conductor and a width of the non-magnetic material covering an inner circumferential side of the conductor in a center portion of the coil in the central axis direction is larger than a sum of a width of the conductor and a width of the non-magnetic material covering an inner circumferential side of the conductor in an end portion of the coil on one side in the central axis direction.

In the inductor according to the embodiment of the present disclosure, the sum of the width of the conductor and the width of the non-magnetic material covering the inner circumferential side of the conductor that are located in the center portion of the coil is larger than the sum of the width of the conductor and the non-magnetic material covering the inner circumferential side of the conductor that are located in the end portion of the coil. Thus, the interval between the lines of magnetic force passing through the end portion of the coil is widened in a width direction of the conductor. Thus, concentration of the lines of magnetic force around corners of the conductor located in end portions of the coil can be suppressed and magnetic saturation can be more effectively suppressed. As a result, with the inductor according to an embodiment of the present disclosure, an increase in the alternating current resistance in an inductor including a magnetic material and a non-magnetic material can be suppressed.

Other features, elements, characteristics and advantages of the present disclosure will become more apparent from the following detailed description of preferred embodiments of the present disclosure with reference to the attached drawings.

DETAILED DESCRIPTION

Hereafter, an inductor according to an embodiment and a manufacturing method of the inductor will be described.

Outline Configuration of Inductor

Figure 1:
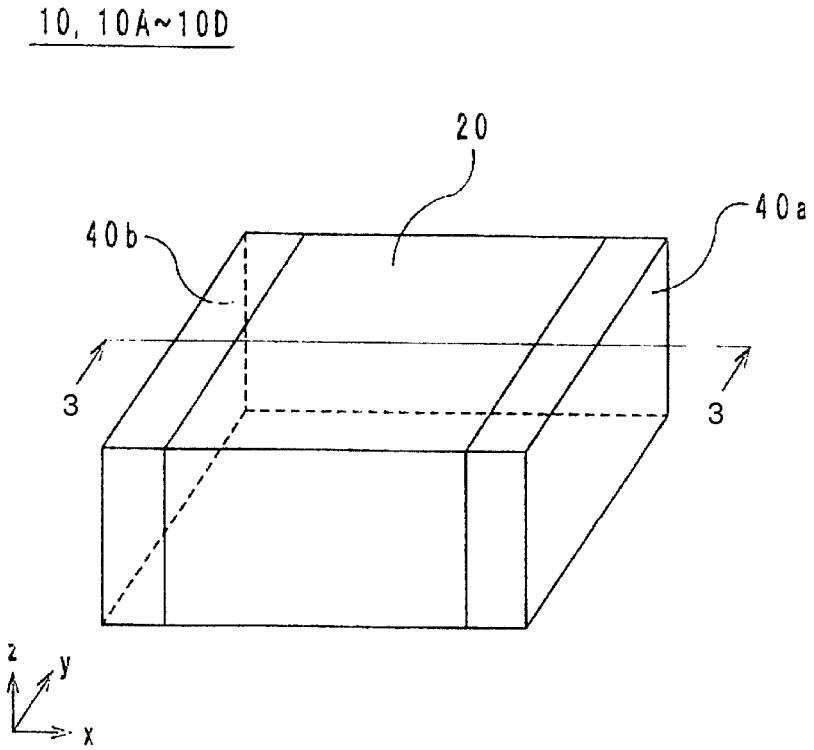
FIG. 1 is a perspective view of the exterior of an inductor according to an embodiment.

Hereafter, an outline configuration of the inductor according to the embodiment will be described while referring to FIG. 1. A stacking direction of an inductor 10 is defined as a z-axis direction, and a direction that extends along the long edges of the inductor and a direction that extends along the short edges when viewed in plan from the z-axis direction are respectively defined as an x-axis direction and a y-axis direction. In addition, a surface that is located on the positive side in the z-axis direction is referred to as an upper surface and a surface that is located on the negative side in the z-axis direction is referred to as a lower surface. The x axis, the y axis and the z axis are orthogonal to one another.

The inductor 10 includes a multilayer body (body) 20, a coil 30 and outer electrodes 40*a* and 40*b*. In addition, the inductor 10 has a substantially rectangular parallelepiped shape as illustrated in FIG. 1.

Configuration of Multilayer Body

The configuration of the multilayer body 20 will be described with reference to FIG. 2. The multilayer body 20 is formed by stacking insulator layers 22*a* to 22*k* on top of one another in order from the positive side in the z-axis direction. In addition, each of the insulator layers 22*a* to 22*k* has a substantially rectangular shape when viewed in plan from the z-axis direction. Examples of a material of the insulator layers 22*a* to 22*k* include magnetic materials (such as a magnetic-powder-containing resin) and non-magnetic materials (such as glass, alumina and composite materials thereof).

Figure 2:
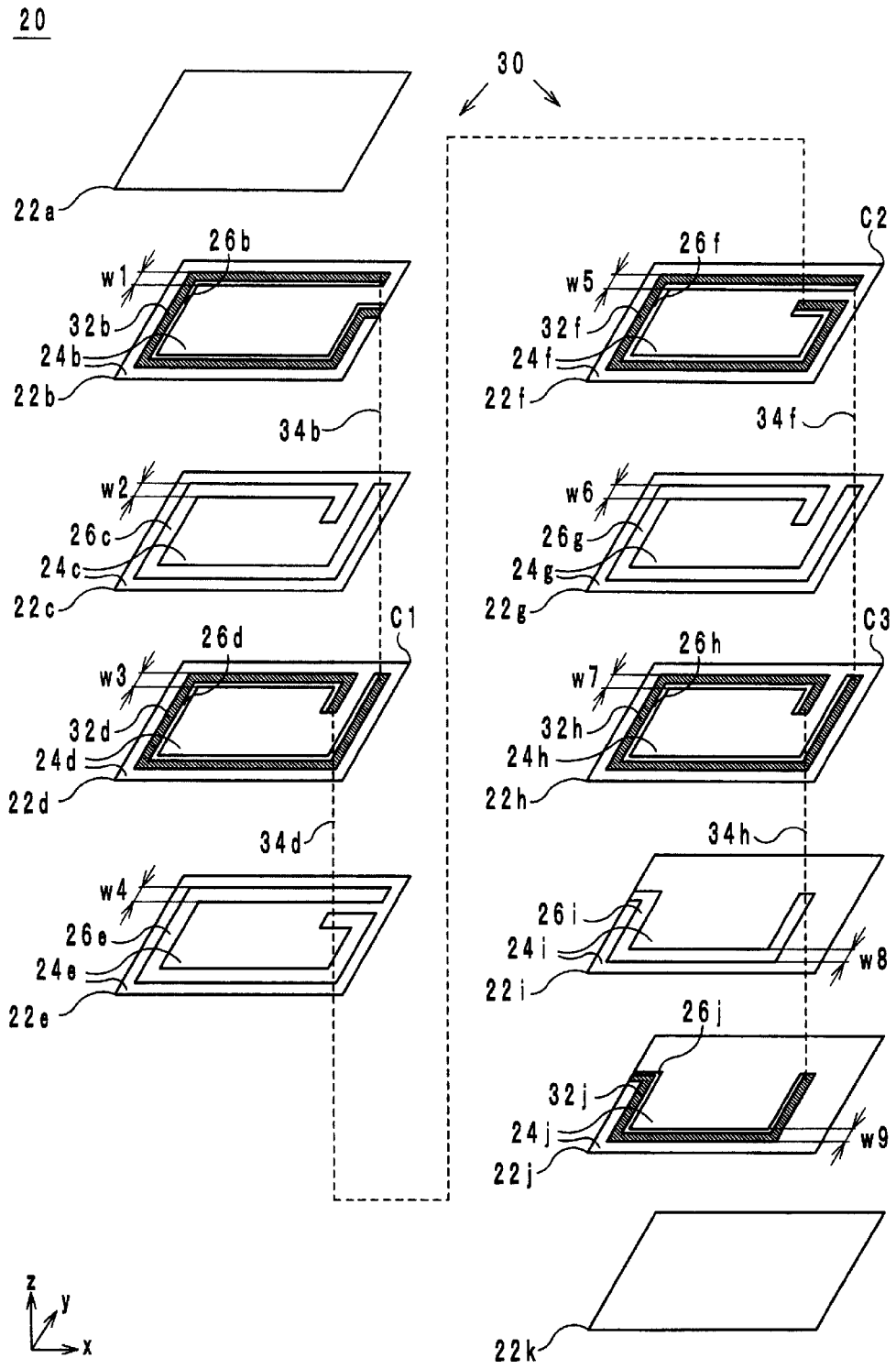
FIG. 2 is an exploded perspective view of a state where the inductor according to the embodiment has been divided into layers on which there are coil conductors and layers on which there are no coil conductors.

The insulator layer 22*a* is located in an end portion of the multilayer body 20 on the positive side in the z-axis direction as illustrated in FIG. 2. In addition, the insulator layer 22*a* is formed of a magnetic material.

The insulator layer 22*b* is located below the insulator layer 22*a*. In addition, the insulator layer 22*b* is formed of a magnetic material layer 24*b* composed of a magnetic material and a non-magnetic material layer 26*b* composed of a non-magnetic material. The non-magnetic material layer 26*b* is a substantially band-shaped non-magnetic material layer provided parallel to an outer edge of the insulator layer 22*b* and has a substantially square annular shape when viewed in plan from the z-axis direction. In addition, when viewed in plan from the z-axis direction, the magnetic material layer 24*b* is provided around the periphery of the non-magnetic material layer 26*b* with a coil conductor 32*b*, which will be described later, interposed therebetween and is also provided inside the substantially square annular shape of the non-magnetic material layer 26*b*.

The insulator layer 22*c* is located below the insulator layer 22*b*. In addition, the insulator layer 22*c* is formed of a magnetic material layer 24*c* composed of a magnetic material and a non-magnetic material layer 26*c* composed of a non-magnetic material. The non-magnetic material layer 26*c* is a substantially band-shaped non-magnetic material layer provided parallel to an outer edge of the insulator layer 22*c* and has a substantially square annular shape when viewed in plan from the z-axis direction. The magnetic material layer 24*c* is provided around the periphery of the non-magnetic material layer 26*c* and inside the substantially square annular shape of the non-magnetic material layer 26*c* when viewed in plan from the z-axis direction.

The insulator layer 22*d* is located below the insulator layer 22*c*. In addition, the insulator layer 22*d* is formed of a magnetic material layer 24*d* composed of a magnetic material and a non-magnetic material layer 26*d* composed of a non-magnetic material. The non-magnetic material layer 26*d* is a substantially band-shaped non-magnetic material layer provided parallel to an outer edge of the insulator layer 22*d* and has a substantially square annular shape when viewed in plan from the z-axis direction. In addition, when viewed in plan from the z-axis direction, the magnetic material layer 24*d* is provided around the periphery of the non-magnetic material layer 26*d* with a coil conductor 32*d*, which will be described later, interposed therebetween and is also provided inside the substantially square annular shape of the non-magnetic material layer 26*d*.

The insulator layer 22*e* is located below the insulator layer 22*d*. In addition, the insulator layer 22*e* is formed of a magnetic material layer 24*e* composed of a magnetic material and a non-magnetic material layer 26*e* composed of a non-magnetic material. The non-magnetic material layer 26*e* is a substantially band-shaped non-magnetic material layer provided parallel to an outer edge of the insulator layer 22*e* and has a substantially square annular shape when viewed in plan from the z-axis direction. The magnetic material layer 24*e* is provided around the periphery of the non-magnetic material layer 26*e* and inside the substantially square annular shape of the non-magnetic material layer 26*e* when viewed in plan from the z-axis direction.

The insulator layer 22*f* is located below the insulator layer 22*e*. In addition, the insulator layer 22*f* is formed of a magnetic material layer 24*f* composed of a magnetic material and a non-magnetic material layer 26*f* composed of a non-magnetic material. The non-magnetic material layer 26*f* is a substantially band-shaped non-magnetic material layer provided parallel to an outer edge of the insulator layer 22*f* and has a substantially square annular shape when viewed in plan from the z-axis direction. In addition, when viewed in plan from the z-axis direction, the magnetic material layer 24*f* is provided around the periphery of the non-magnetic material layer 26*f* with a coil conductor 32*f*, which will be described later, interposed therebetween and is also provided inside the substantially square annular shape of the non-magnetic material layer 26*f*.

The insulator layer 22*g* is located below the insulator layer 22*f*. In addition, the insulator layer 22*g* is formed of a magnetic material layer 24*g* composed of a magnetic material and a non-magnetic material layer 26*g* composed of a non-magnetic material. The non-magnetic material layer 26*g* is a substantially band-shaped non-magnetic material layer provided parallel to an outer edge of the insulator layer 22*g* and has a substantially square annular shape when viewed in plan from the z-axis direction. The magnetic material layer 24*g* is provided around the periphery of the non-magnetic material layer 26*g* and inside the substantially square annular shape of the non-magnetic material layer 26*g* when viewed in plan from the z-axis direction.

The insulator layer 22*h* is located below the insulator layer 22*g*. In addition, the insulator layer 22*h* is formed of a magnetic material layer 24*h* composed of a magnetic material and a non-magnetic material layer 26*h* composed of a non-magnetic material. The non-magnetic material layer 26*h* is a substantially band-shaped non-magnetic material layer provided parallel to an outer edge of the insulator layer 22*h* and has a substantially square annular shape when viewed in plan from the z-axis direction. In addition, when viewed in plan from the z-axis direction, the magnetic material layer 24*h* is provided around the periphery of the non-magnetic material layer 26*h* with a coil conductor 32*h*, which will be described later, interposed therebetween and is also provided inside the substantially square annular shape of the non-magnetic material layer 26*h*.

The insulator layer 22*i* is located below the insulator layer 22*h*. In addition, the insulator layer 22*i* is formed of a magnetic material layer 24*i* composed of a magnetic material and a non-magnetic material layer 26*i* composed of a non-magnetic material. The non-magnetic material layer 26*i* is a substantially band-shaped non-magnetic material layer provided parallel to outer edges of the insulator layer 22*i* on both the positive and negative sides in the x-axis direction and parallel to an outer edge of the insulator layer 22*i* on the negative side in the y-axis direction, and has a substantially backward C shape when viewed in plan from the z-axis direction. The magnetic material layer 24*i* is provided in portions of the insulator layer 22*i* other than portions where the non-magnetic material layer 26*i* is provided.

The insulator layer 22*j* is located below the insulator layer 22*i*. In addition, the insulator layer 22*j* is formed of a magnetic material layer 24*j* composed of a magnetic material and a non-magnetic material layer 26*j* composed of a non-magnetic material. The non-magnetic material layer 26*j* is a substantially band-shaped non-magnetic material layer provided parallel to outer edges of the insulator layer 22*j* on both the positive and negative sides in the x-axis direction and parallel to an outer edge of the insulator layer 22*j* on the negative side in the y-axis direction, and has a substantially backward C shape when viewed in plan from the z-axis direction. The magnetic material layer 24*j* is provided in portions of the insulator layer 22*j* other than portions where the non-magnetic material layer 26*j* and a coil conductor 32*j*, which will be described later, are provided.

The insulator layer 22*k* is located in an end portion of the multilayer body 20 on the negative side in the z-axis direction. In addition, the insulator layer 22*k* is formed of a magnetic material.

Configuration of Outer Electrodes

The configuration of the outer electrodes 40*a* and 40*b* will be described with reference to FIG. 1. As illustrated in FIG. 1, the outer electrode 40*a* is provided so as to cover a surface of the multilayer body 20 on the positive side in the x-axis direction and part of each of the surfaces surrounding that surface. In addition, the outer electrode 40*b* is provided so as to cover a surface of the multilayer body 20 on the negative side in the x-axis direction and part of each of the surfaces surrounding that surface. The material of the outer electrodes 40*a* and 40*b* is a conductive material such as Au, Ag, Pd, Cu or Ni.

Configuration of Coil

The configuration of the coil 30 will be described with reference to FIG. 2. As illustrated in FIG. 2, the coil 30 is located inside the multilayer body 20 and is formed of the coil conductors (conductors) 32*b*, 32*d*, 32*f*, 32*h* and 32*j* and via conductors 34*b*, 34*d*, 34*f* and 34*h*. In addition, the coil 30 has a substantially helical shape and a central axis of the helical shape is parallel to the z axis. In short, the coil 30 has a helical shape that loops around while advancing in the stacking direction. The material of the coil 30 is a conductive material such as Au, Ag, Pd, Cu or Ni.

The coil conductor 32*b* is a line-shaped conductor that is provided so as to extend alongside the non-magnetic material layer 26*b*. Therefore, the coil conductor 32*b* has a substantially square annular shape when viewed in plan from the z-axis direction. In addition, the coil conductor 32*b* contacts the non-magnetic material layer 26*b* on the inner circumferential side of the substantially square annular shape formed by the coil conductor 32*b*. Furthermore, the upper surface of the coil conductor 32*b* contacts the insulator layer 22*a* and the lower surface of the coil conductor 32*b* contacts the non-magnetic material layer 26*c*. Here, a sum w1 of a width of the coil conductor 32*b* and a width of the non-magnetic material layer 26*b* located on the inner circumferential side of the coil conductor 32*b* is smaller than a width w2 of the non-magnetic material layer 26*c*. One end of the coil conductor 32*b* is exposed at the surface of the multilayer body 20 from an outer edge of the insulator layer 22*b* on the positive side in the x-axis direction and is connected to the outer electrode 40*a*. The other end of the coil conductor 32*b* is connected to the via conductor 34*b*, which penetrates through the insulator layer 22*c* in the z-axis direction, in the vicinity of a corner formed by an outer edge of the insulator layer 22*b* on the positive side in the x-axis direction and an outer edge of the insulator layer 22*b* on the positive side in the y-axis direction.

The coil conductor 32*d* is a line-shaped conductor that is provided so as to extend alongside the non-magnetic material layer 26*d*. Therefore, the coil conductor 32*d* has a substantially square annular shape when viewed in plan from the z-axis direction. In addition, the coil conductor 32*d* contacts the non-magnetic material layer 26*d* on the inner circumferential side of the substantially square annular shape formed by the coil conductor 32*d*. In addition, the upper surface of the coil conductor 32*d* contacts the non-magnetic material layer 26*c* and the lower surface of the coil conductor 32*d* contacts the non-magnetic material layer 26*e*. Here, a sum w3 of a width of the coil conductor 32*d* and a width of the non-magnetic material layer 26*d* located on the inner circumferential side of the coil conductor 32*d* is larger than the width w2 of the non-magnetic material layer 26*c* and smaller than a width w4 of the non-magnetic material layer 26*e*. One end of the coil conductor 32*d* is connected to the via conductor 34*b* in the vicinity of a corner C1 formed by an outer edge of the insulator layer 22*d* on the positive side in the x-axis direction and an outer edge of the insulator layer 22*d* on the positive side in the y-axis direction. In addition, the other end of the coil conductor 32*d* is located in the vicinity of the corner C1 and a little further toward the center of the insulator layer 22*d* than the one end of the coil conductor 32*d*, and furthermore is connected to the via conductor 34*d*, which penetrates through the insulator layer 22*e* in the z-axis direction.

The coil conductor 32*f* is a line-shaped conductor that is provided so as to extend alongside the non-magnetic material layer 26*f*. Therefore, the coil conductor 32*f* has a substantially square annular shape when viewed in plan from the z-axis direction. In addition, the coil conductor 32*f* contacts the non-magnetic material layer 26*f* on the inner circumferential side of the substantially square annular shape formed by the coil conductor 32*f*. In addition, the upper surface of the coil conductor 32*f* contacts the non-magnetic material layer 26*e* and the lower surface of the coil conductor 32*f* contacts the non-magnetic material layer 26*g*. Here, a sum w5 of a width of the coil conductor 32*f* and a width of the non-magnetic material layer 26*f* located on the inner circumferential side of the coil conductor 32*f* is larger than the width w4 of the non-magnetic material layer 26*e* and larger than a width w6 of the non-magnetic material layer 26*g*. One end of the coil conductor 32*f* is connected to the via conductor 34*d* in the vicinity of a corner C2 formed by an outer edge of the insulator layer 22*f* on the positive side in the x-axis direction and an outer edge of the insulator layer 22*f* on the positive side in the y-axis direction. In addition, the other end of the coil conductor 32*f* is located in the vicinity of the corner C2 and a little further toward the outer edge of the insulator layer 22*f* than the one end of the coil conductor 32*f*, and furthermore is connected to the via conductor 34*f*, which penetrates through the insulator layer 22*g* in the z-axis direction.

The coil conductor 32*h* is a line-shaped conductor that is provided so as to extend alongside the non-magnetic material layer 26*h*. Therefore, the coil conductor 32*h* has a substantially square annular shape when viewed in plan from the z-axis direction. In addition, the coil conductor 32*h* contacts the non-magnetic material layer 26*h* on the inner circumferential side of the substantially square annular shape formed by the coil conductor 32*h*. In addition, the upper surface of the coil conductor 32*h* contacts the non-magnetic material layer 26*g* and the lower surface of the coil conductor 32*h* contacts the non-magnetic material layer 26*i*. Here, a sum w7 of a width of the coil conductor 32*h* and a width of the non-magnetic material layer 26*h* located on the inner circumferential side of the coil conductor 32*h* is smaller than the width w6 of the non-magnetic material layer 26*g* and larger than a width w8 of the non-magnetic material layer 26*i*. One end of the coil conductor 32*h* is connected to the via conductor 34*f* in the vicinity of a corner C3 formed by an outer edge of the insulator layer 22*h* on the positive side in the x-axis direction and an outer edge of the insulator layer 22*h* on the positive side in the y-axis direction. In addition, the other end of the coil conductor 32*h* is located in the vicinity of the corner C3 and a little further toward the center of the insulator layer 22*h* than the one end of the coil conductor 32*h*, and furthermore is connected to the via conductor 34*h*, which penetrates through the insulator layer 22*i* in the z-axis direction.

The coil conductor 32*j* is a line-shaped conductor that is provided so as to extend alongside the non-magnetic material layer 26*j*. Therefore, the coil conductor 32*j* has a substantially backward C shape when viewed in plan from the z-axis direction. In addition, the coil conductor 32*j* contacts the non-magnetic material layer 26*j* on the inner circumferential side of the substantially backward C shape formed by the coil conductor 32*j*. In addition, the upper surface of the coil conductor 32*j* contacts the non-magnetic material layer 26*i* and the lower surface of the coil conductor 32*j* contacts the insulator layer 22*k*. Here, a sum w9 of a width of the coil conductor 32*j* and a width of the non-magnetic material layer 26*j* located on the inner circumferential side of the coil conductor 32*j* is smaller than the width w8 of the non-magnetic material layer 26*i*. One end of the coil conductor 32*j* is connected to the via conductor 34*h* in the vicinity of a corner formed by an outer edge of the insulator layer 22*j* on the positive side in the x-axis direction and an outer edge of the insulator layer 22*j* on the positive side in the y-axis direction. Furthermore, the other end of the coil conductor 32*j* is exposed at the surface of the multilayer body 20 from the outer edge of the insulator layer 22*j* on the negative side in the x-axis direction and is connected to the outer electrode 40*b*.

Figure 3:
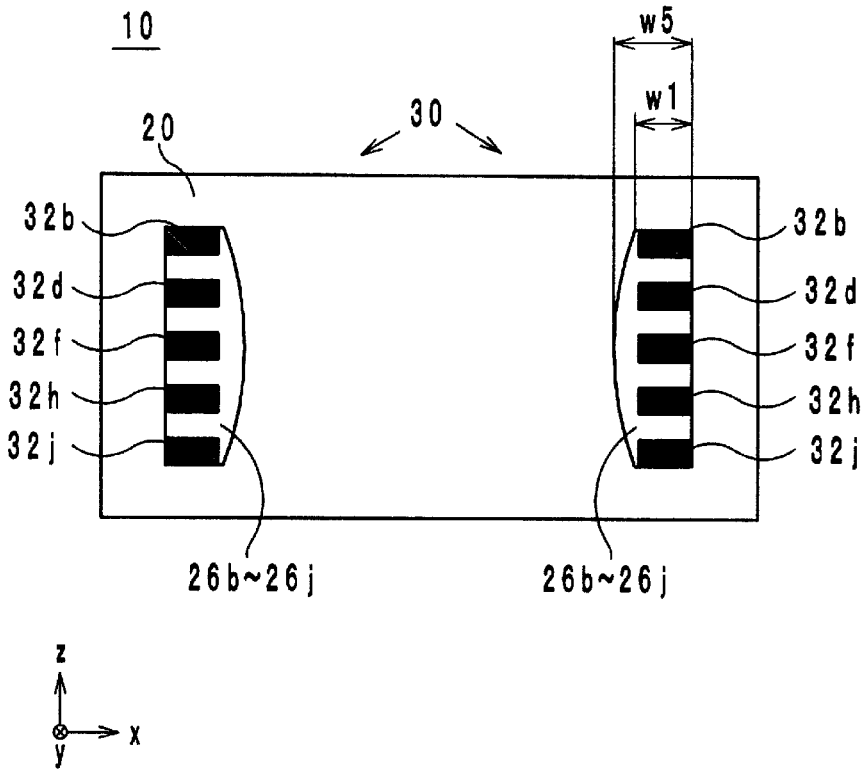
FIG. 3 is a sectional view taken along section 3-3 in FIG. 1.

In the thus-configured inductor 10, the inner circumferential surface of the coil 30 is covered by the non-magnetic material layers 26*b* to 26*j*, which form circular arcs when viewed from a direction that is orthogonal to the z-axis direction, as illustrated in FIG. 3. In addition, the sum w5 of the width of the coil conductor 32*f* and the width of the non-magnetic material layer 26*f* covering the inner circumferential side of the coil conductor 32*f* that are located in a center portion of the coil 30 in the z-axis direction (central axis direction) is larger than the sum w1 of the width of the coil conductor 32*b* and the width of the non-magnetic material layer 26*b* covering the inner circumferential side of the coil conductor 32*b* that are located in an end portion of the coil 30 on the positive side in the z-axis direction (one side in central axis direction).

Manufacturing Method

A method of manufacturing the inductor according to the embodiment will be described with reference to FIG. 1 and FIGS. 4 to 13. Hereafter, a manufacturing method in which a single inductor is the target will be described, but in reality a single inductor would be obtained by manufacturing and then cutting into individual pieces a mother multilayer body in which a plurality of multilayer bodies are connected to one another and then forming the outer electrodes on the individual inductors.

Figure 4:
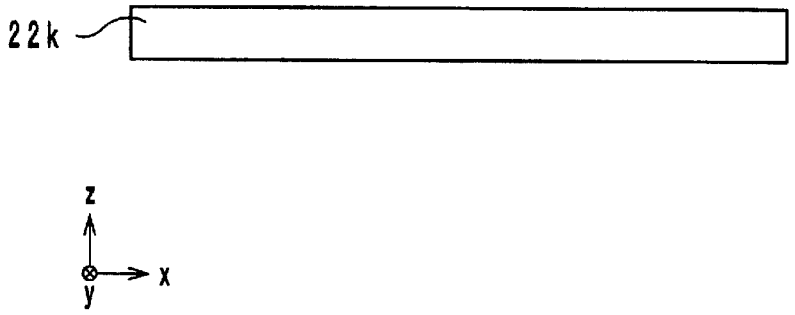
FIG. 4 is a sectional view of the inductor during its manufacture.

First, a magnetic material paste obtained by mixing a ferrite powder, which is a magnetic material, with an organic component such as a binder into a paste is applied onto a holding substrate such as an alumina substrate using a printing method and then dried to form the insulator layer 22*k* illustrated in FIG. 4.

Figure 5:
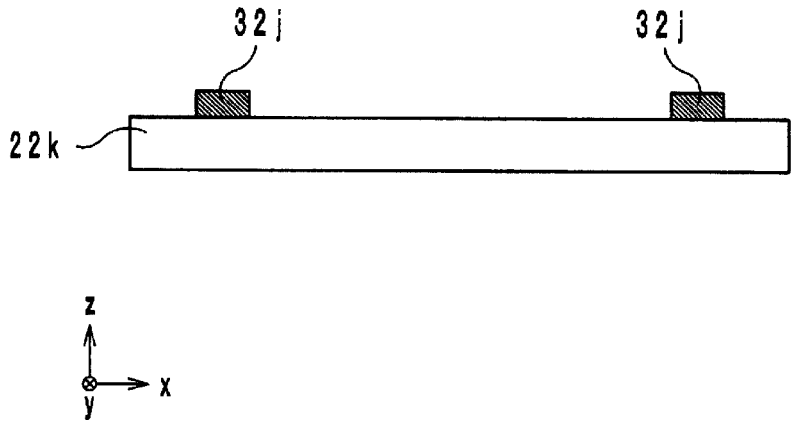
FIG. 5 is a sectional view of the inductor during its manufacture.

Next, a conductive paste having Ag, Pd, Cu, Ni or the like as a main component is applied onto the insulator layer 22*k* using a printing method and then dried to form the coil conductor 32*j* illustrated in FIG. 5.

Figure 6:
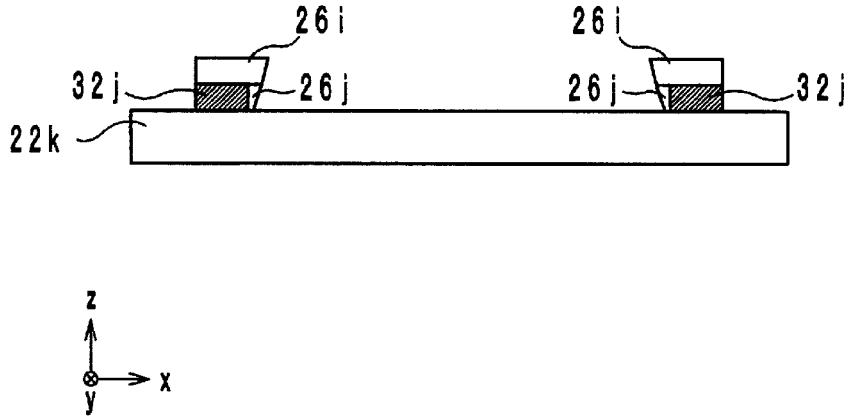
FIG. 6 is a sectional view of the inductor during its manufacture.

In addition, a non-magnetic material paste formed of borosilicate glass and a ceramic filler is applied so as to cover the upper surface and the inner circumferential side of the coil conductor 32*j* using a printing method and then dried to form the non-magnetic material layers 26*i* and 26*j* as illustrated in FIG. 6. In order to allow formation of the via conductor 34*h*, the non-magnetic material paste is not applied to the upper surface of one end of the coil conductor 32*j*.

Figure 7:
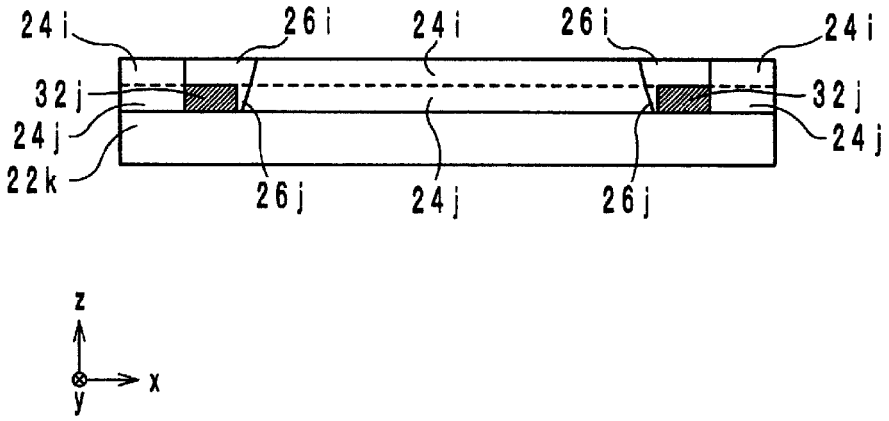
FIG. 7 is a sectional view of the inductor during its manufacture.

After formation of the non-magnetic material layers 26*i* and 26*j*, as illustrated in FIG. 7, a magnetic material paste is applied to parts of the insulator layer 22*k* on which the non-magnetic material layer 26*j* and the coil conductor 32*j* have not been formed using a printing method and then dried, in order to form the magnetic material layers 24*i* and 24*j*. Thus, formation of the insulator layers 22*i* and 22*j* is completed. After formation of the insulator layers 22*i* and 22*j*, a conductive paste is applied using a printing method to fill the via hole in order to form the via conductor 34*h*.

After that, steps similar to the steps for forming the coil conductor 32*j*, the non-magnetic material layers 26*i* and 26*j*, the magnetic material layers 24*i* and 24*j* and the via conductor 34*h* are repeated. However, non-magnetic material paste is applied so that the non-magnetic material layer 26*f* located in a center portion in the z-axis direction maximally juts out on the inner circumferential side of the coil 30. In this way, the insulator layers 22*c* to 22*h*, the coil conductors 32*b*, 32*d*, 32*f* and 32*h* and the via conductors 34*b*, 34*d* and 34*f* are formed.

Figure 8:
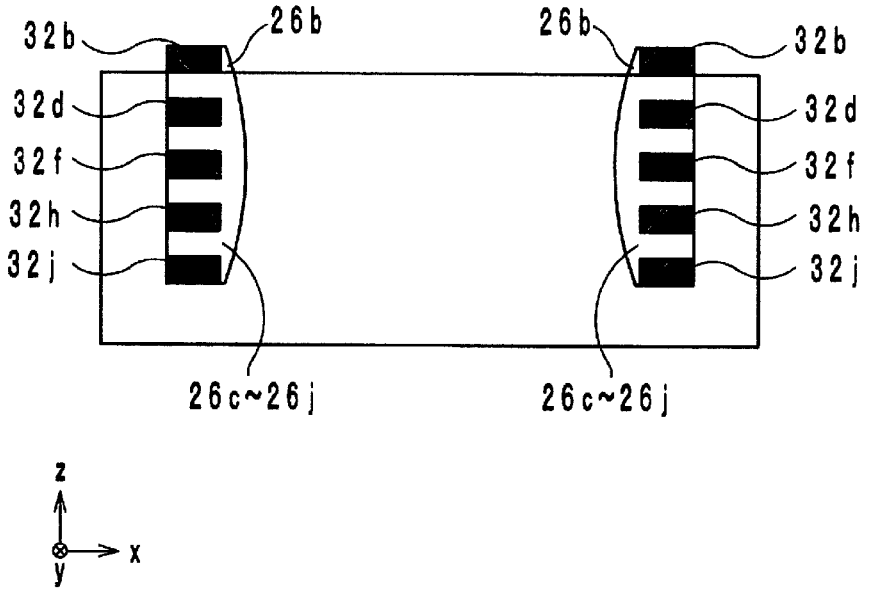
FIG. 8 is a sectional view of the inductor during its manufacture.
Figure 9:
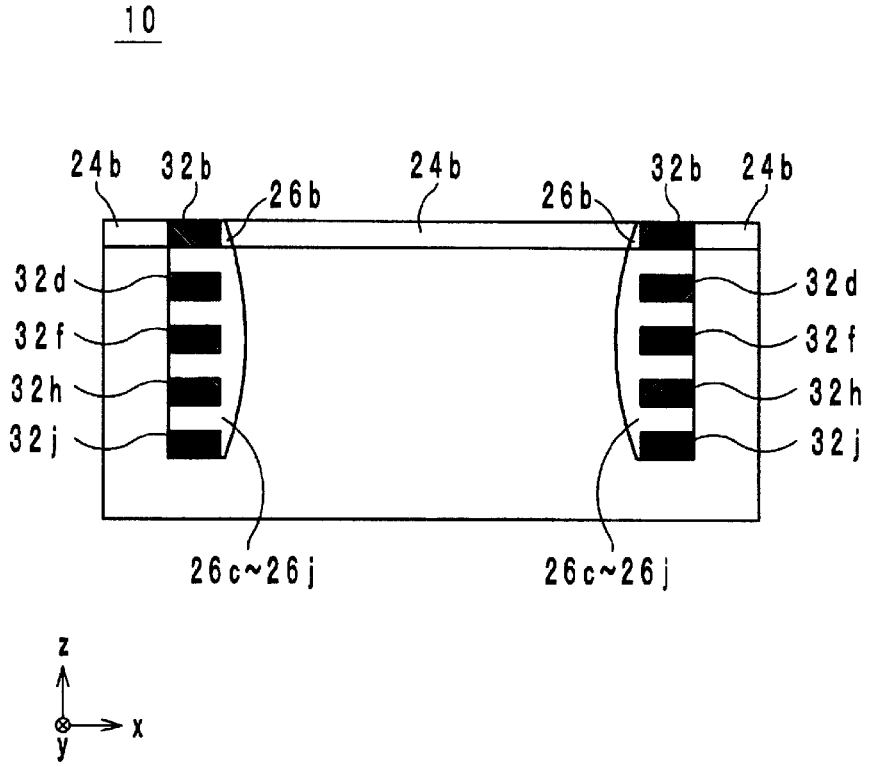
FIG. 9 is a sectional view of the inductor during its manufacture.

After formation of the coil conductor 32*b*, as illustrated in FIG. 8, the non-magnetic material paste is applied so as to cover the inner circumferential side of the coil conductor 32*b* using a printing method and then dried, to form the non-magnetic material layer 26*b*. After formation of the non-magnetic material layer 26*b*, as illustrated in FIG. 9, the magnetic material paste is applied to parts of the insulator layer 22*c* on which the non-magnetic material layer 26*b* and the coil conductor 32*b* have not been formed using a printing method and then dried, in order to form the magnetic material layer 24*b*. In this way, the insulator layer 22*b* is formed. In addition, the magnetic material paste is applied to the entirety of the upper surface of the insulator layer 22*b* using a printing method to form the insulator layer 22*a*, and thereby formation of an unfired mother multilayer body is completed.

Next, the unfired mother multilayer body is cut into individual multilayer bodies 20 of certain dimensions using a dicing saw and a plurality of unfired multilayer bodies 20 are thus obtained.

Each unfired multilayer body 20 is subjected to a de-binder treatment and firing. The de-binder treatment is for example performed under conditions of 400° C. for 2 hours in a low oxygen atmosphere. The firing is for example performed under conditions of 2.5 hours at 870° C. to 900° C.

A fired multilayer body 20 is obtained through the above-described process. The multilayer body 20 is chamfered by being subjected to barrel finishing. After that, an electrode paste composed of a conductive material having Ag as a main component is applied to surfaces of the multilayer body 20. The applied electrode paste is baked under conditions of a temperature of around 800° C. for around 1 hour. In this way, silver electrodes are formed that will become the outer electrodes 40*a* and 40*b*.

Finally, formation of the outer electrodes 40*a* and 40*b* is completed by performing Ni plating and Sn plating on the surfaces of the silver electrodes. Manufacture of the inductor 10 illustrated in FIG. 1 is completed through the above-described processes.

Effects

Figure 10:
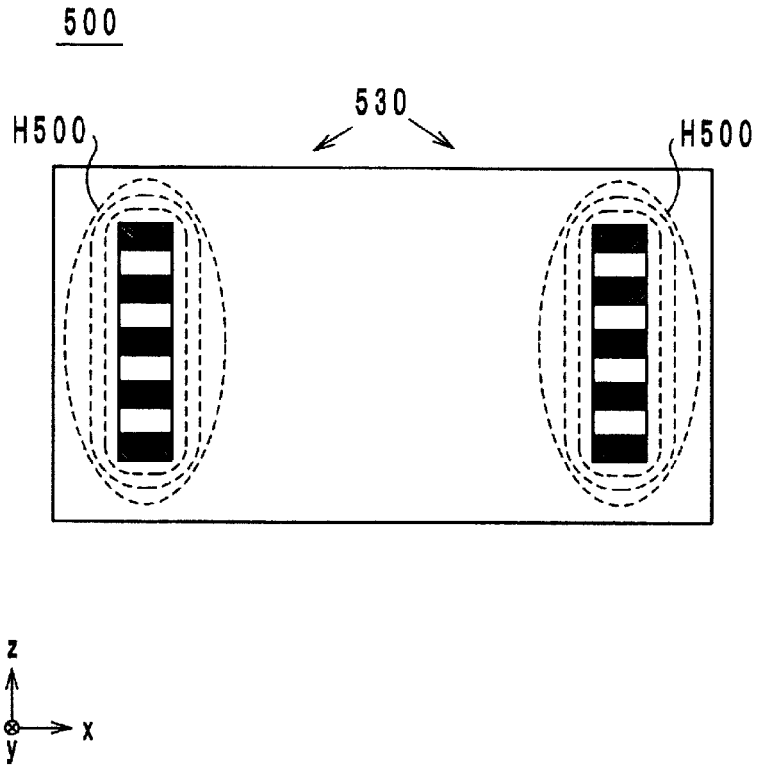
FIG. 10 PRIOR ART
FIG. 10 is a diagram obtained by adding lines of magnetic force to a sectional view of an inductor of the related art.
Figure 11:
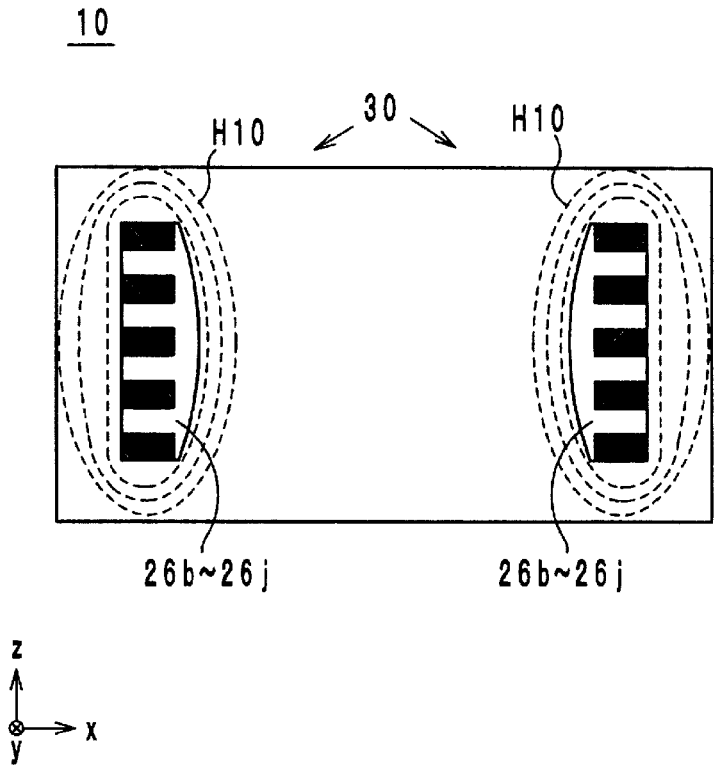
FIG. 11 is a diagram obtained by adding lines of magnetic force to a sectional view of the inductor according to the embodiment.

Next the effects of the present disclosure will be described with reference to FIG. 3, FIG. 10 and FIG. 11. In the inductor 10, magnetic saturation can be suppressed. Specifically, in an inductor 500 of the related art in which the inner circumferential surface of a coil is not covered by a non-magnetic material layer as illustrated in FIG. 10, when a current flows, lines of magnetic force H500 are concentrated around corners of coil conductors located in end portions of a coil 530 of the inductor 500 and magnetic saturation is likely to occur. However, in the inductor 10, as illustrated in FIG. 3, the sum w5 of the width of the coil conductor 32*f* and the width of the non-magnetic material layer 26*f* covering the inner circumferential side of the coil conductor 32*f* that are located in a center portion of the coil 30 in the z-axis direction (central axis direction) is larger than the sum w1 of the width of the coil conductor 32*b* and the width of the non-magnetic material layer 26*b* covering the inner circumferential side of the coil conductor 32*b* that are located in the end portion of the coil 30 on the positive side in the z-axis direction (one side in central axis direction). Thus, in the inductor 10, lines of magnetic force H10 generated when a current flows form shapes close to an ellipse, and therefore the interval between the lines of magnetic force H10 becomes wider in the width direction of the conductors as illustrated in FIG. 11. As a result, in the inductor 10, concentration of lines of magnetic force around corners of conductors located in the end portions of the coil 30, particularly on the inner circumferential side of the coil 30 can be suppressed and magnetic saturation can be suppressed.

First Modification

Figure 12:
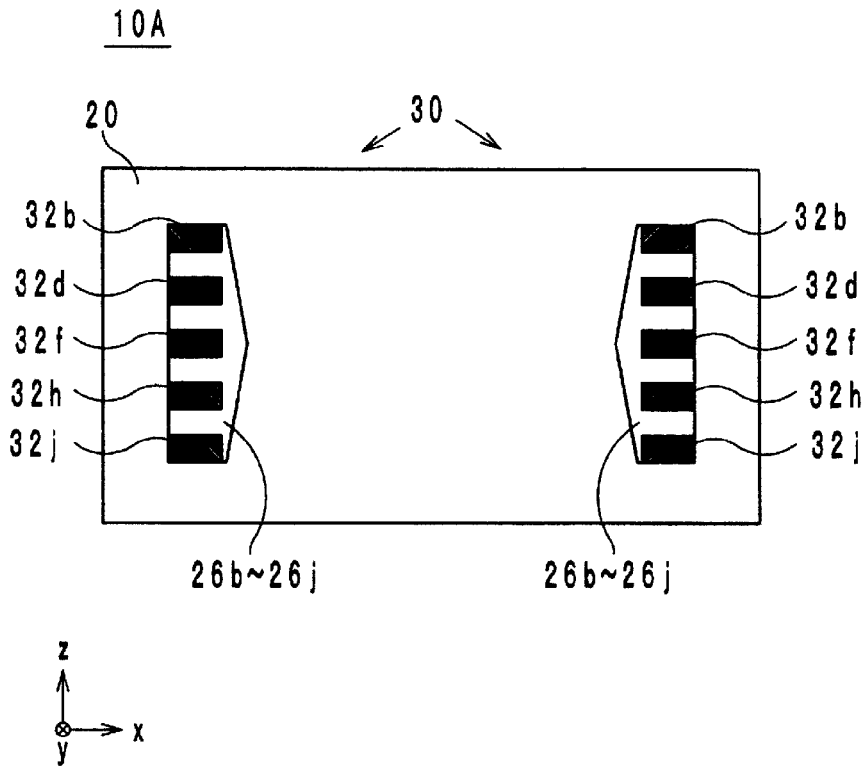
FIG. 12 is a sectional view of an inductor according to a first modification.

A first modification will be described with reference to FIG. 12. An inductor 10A according to the first modification and the inductor 10 differ from each other in terms of the shape of the non-magnetic material layers 26*b* to 26*j* that cover the inner circumferential surface of the coil 30. In the inductor 10A, as illustrated in FIG. 12, the non-magnetic material layers 26*b* to 26*j*, which cover the inner circumferential surface of the coil 30, cover the inner circumferential surface of the coil 30 in such a way as to form a triangular shape with a center portion in the z-axis direction being an apex when viewed from a direction orthogonal to the z-axis direction. Also in the thus-configured inductor 10A, concentration of lines of magnetic force around corners of conductors located in end portions of the coil can be suppressed and magnetic saturation can be suppressed. The rest of the configuration of the inductor 10A is the same as that of the inductor 10. Therefore, other than the shape of the non-magnetic material layers 26*b* to 26*j* covering the inner circumferential surface of the coil 30, description of the inductor 10A is the same as that of the inductor 10.

Second Modification

Figure 13:
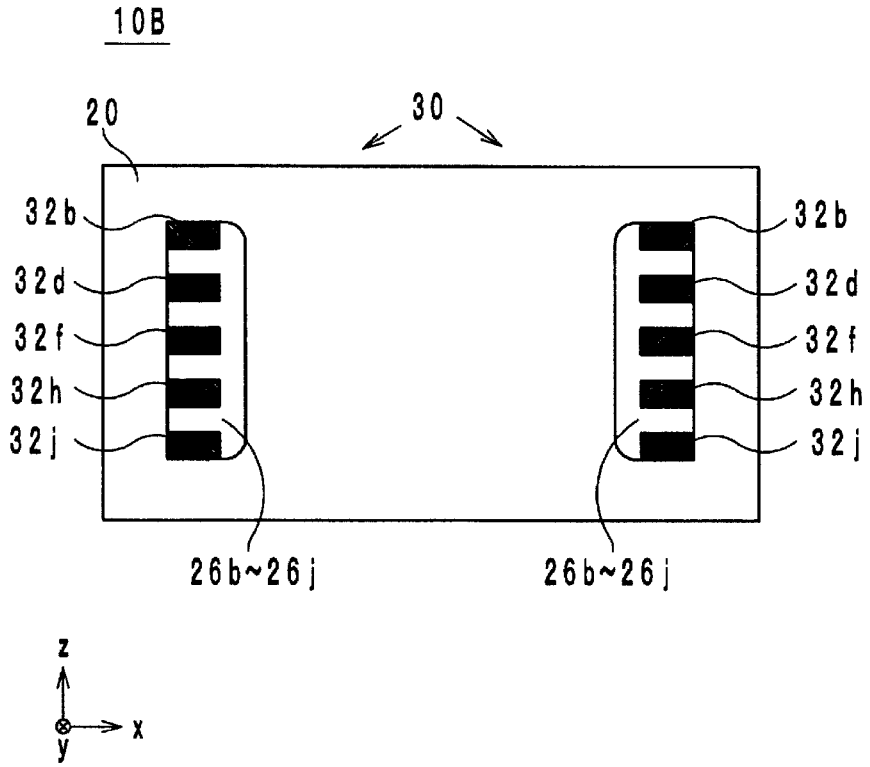
FIG. 13 is a sectional view of an inductor according to a second modification.

A second modification will be described with reference to FIG. 13. An inductor 10B according to the second modification and the inductor 10 differ from each other in terms of the shape of the non-magnetic material layers 26*b* to 26*j* that cover the inner circumferential surface of the coil 30. In the inductor 10B, as illustrated in FIG. 13, when viewed in a direction orthogonal to the z-axis direction, both end portions of inner circumferential outer edges of the non-magnetic material layers 26*b* to 26*j*, which cover the inner circumferential surface of the coil 30 form a substantially circular arc shape and the center portions that connect the end portions to each other both have a shape that is substantially parallel to the z-axis direction. Also in the thus-configured inductor 10B, concentration of lines of magnetic force around corners of conductors located in end portions of the coil can be suppressed and magnetic saturation can be suppressed. The rest of the configuration of the inductor 10B is the same as that of the inductor 10. Therefore, other than the shape of the non-magnetic material layers 26*b* to 26*j* covering the inner circumferential surface of the coil 30, description of the inductor 10B is the same as that of the inductor 10.

Third Modification

Figure 14:
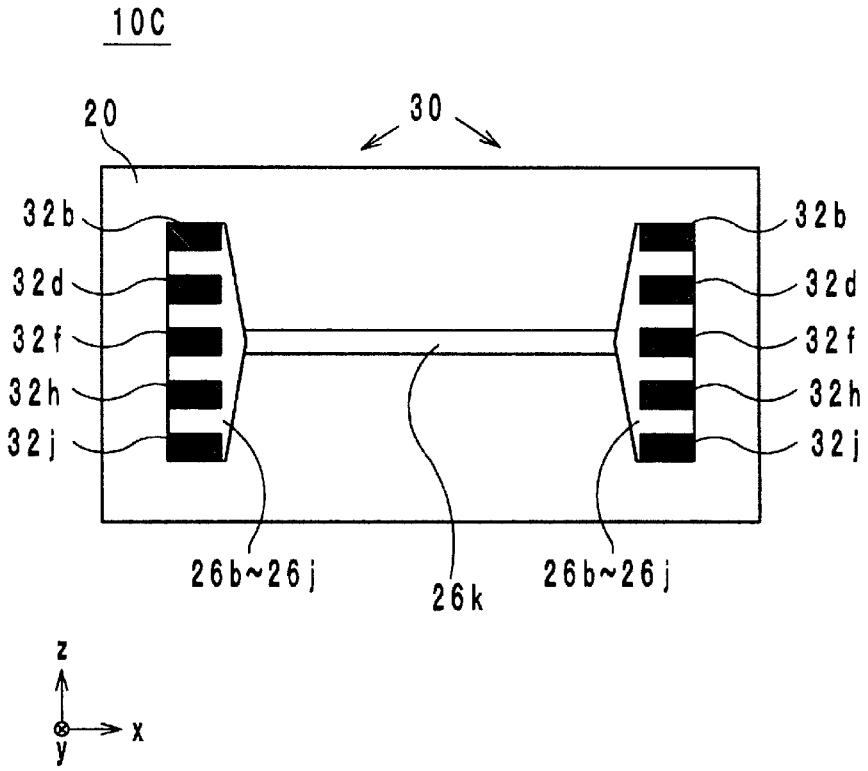
FIG. 14 is a sectional view of an inductor according to a third modification.

A third modification will be described with reference to FIG. 14. An inductor 10C according to the third modification and the inductor 10 differ from each other in terms of the shape of the non-magnetic material layers 26*b* to 26*j* that cover the inner circumferential surface of the coil and in that a non-magnetic material layer 26*k* is newly added. In the inductor 10C, as illustrated in FIG. 14, the non-magnetic material layers 26*b* to 26*j*, which cover the inner circumferential surface of the coil 30, cover the inner circumferential surface of the coil 30 in such a way as to form a triangular shape with a center portion in the z-axis direction being an apex when viewed from a direction orthogonal to the z-axis direction. In addition to this, the non-magnetic material layer 26*k* is provided in the vicinity of a center portion of the coil 30 so as to be substantially parallel to a plane orthogonal to the z-axis direction. Also in the thus-configured inductor 10C, concentration of lines of magnetic force around corners of conductors located in end portions of the coil can be suppressed and magnetic saturation can be suppressed. As a result of providing the non-magnetic material layer 26*k*, magnetic saturation on the inner circumferential side of the coil 30 can be further suppressed. The rest of the configuration of the inductor 10C is the same as that of the inductor 10. Therefore, other than the shape of the non-magnetic material layers 26*b* to 26*j* covering the inner circumferential surface of the coil 30 and the new addition of the non-magnetic material layer 26*k*, description of the inductor 10C is the same as that of the inductor 10.

Fourth Modification

Figure 15:
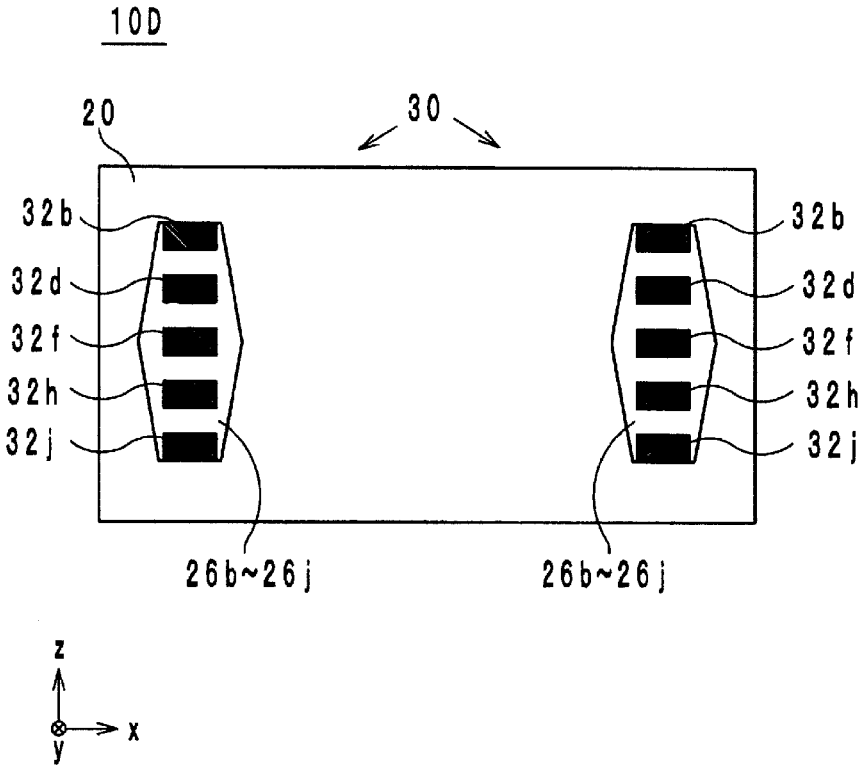
FIG. 15 is an exploded perspective view of an inductor according to a fourth modification.

A fourth modification will be described with reference to FIG. 15. An inductor 10D according to the fourth modification and the inductor 10 differ from each other in terms of the shape of the non-magnetic material layers 26*b* to 26*j* that cover the inner circumferential surface of the coil 30 and in that an outer circumferential surface of the coil 30 is also covered by the non-magnetic material layers 26*b* to 26*j*. In the inductor 10D, as illustrated in FIG. 15, the non-magnetic material layers 26*b* to 26*j* cover the inner circumferential surface of the coil 30 in such a way as to form a triangular shape with a center portion in the z-axis direction being an apex when viewed from a direction orthogonal to the z-axis direction. In addition to this, in the inductor 10D, the non-magnetic material layers 26*b* to 26*j* cover the outer circumferential surface in such a way as to form a triangular shape with a center portion in the z-axis direction being an apex. In the thus-configured inductor 10D, as a result of the outer circumferential surface also being covered by the non-magnetic material layers in addition to the inner circumferential surface of the coil 30, the lines of magnetic force generated when a current flows are spread out even more in the width direction of the conductors than in the inductor 10. Thus, concentration of lines of magnetic force around corners of conductors located in end portions of the coil can be further suppressed and magnetic saturation can be even more effectively suppressed. The rest of the configuration of the inductor 10D is the same as that of the inductor 10. Therefore, other than the shapes of the non-magnetic material layers 26*b* to 26*j* covering the inner circumferential surface of the coil 30 and the fact that the outer circumferential surface of the coil 30 is also covered by the non-magnetic material layers 26*b* to 26*j*, the description of the inductor 10D is the same as that of the inductor 10.

Figure 16:
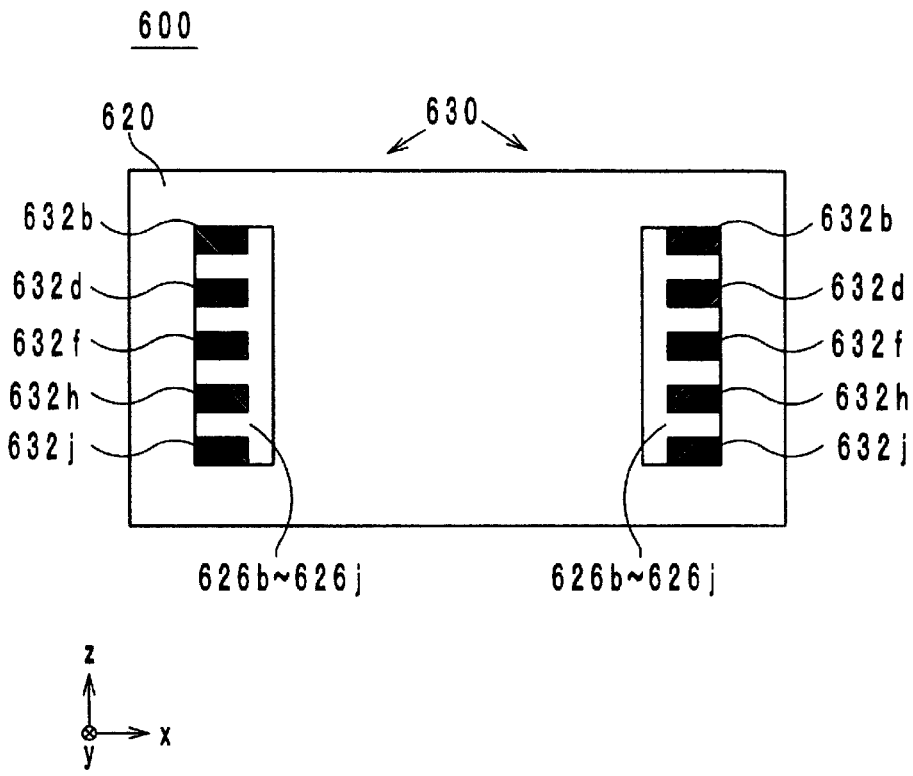
FIG. 16 is a sectional view of an inductor according to a comparative example.

The inventors of the present application performed experiments in order to confirm the above-described effects. In the experiments, a sample S1 corresponding to the inductor of the related art, a sample S2 corresponding to an inductor 600 obtained by providing non-magnetic material layers that form outer edges parallel to the z-axis direction at the inner circumferential surface in the inductor of the related art as illustrated in FIG. 16, a sample S3 that corresponds to the inductor 10, a sample S4 that corresponds to the inductor 10A, a sample S5 that corresponds to the inductor 10B, a sample S6 that corresponds to the inductor 10C and a sample S7 that corresponds to the inductor 10D were used. There were 8 coil conductors in each of the samples and the dimensions of the samples were about 1.6 mm×0.8 mm×0.8 mm. In addition, a line width of the coil conductors was about 140 μm and the thickness was about 50 μm. In addition, the interval between the coil conductors was about 10 μm and a side gap was about 100 μm. The width of portions of the non-magnetic material layers, which were provided so as to cover the inner circumferential surface of the coil in each of the samples, having the largest width was about 20 μm.

In the experiments, in order to investigate an alternating current resistance Rac in each of the samples, a peak pulse current $I_{p\text{-}p}$, a direct current Idc, a loss P and a direct current resistance Rdc were measured for each of the samples at each frequency. The alternating current resistance Rac was obtained by substituting the measured values into the following expression.

$$Rac=(P-Rdc\times Idc^2)/(I_{p\text{-}p}/2\sqrt{3})^2$$

Values of alternating current resistance obtained as results of the experiments are illustrated in Table 1 and taking the alternating current resistance of sample S1 as 100%, ratios of the alternating current resistances of samples S2 to S7 with respect to this value are illustrated in Table 2.

TABLE 1

| | Alternating Current Resistance (Ω) | | | | | | |
|---|---|---|---|---|---|---|---|
| Frequency (MHz) | Sample S1 | Sample S2 | Sample S3 | Sample S4 | Sample S5 | Sample S6 | Sample S7 |
| 2 | 0.196 | 0.209 | 0.169 | 0.164 | 0.167 | 0.185 | 0.163 |
| 4 | 0.414 | 0.409 | 0.398 | 0.386 | 0.396 | 0.374 | 0.379 |

TABLE 2

| | Alternating Current Resistance Ratio (%) | | | | | | |
|---|---|---|---|---|---|---|---|
| Frequency (MHz) | Sample S1 | Sample S2 | Sample S3 | Sample S4 | Sample S5 | Sample S6 | Sample S7 |
| 2 | — | 106 | 86 | 84 | 85 | 94 | 83 |
| 4 | — | 99 | 96 | 93 | 96 | 90 | 92 |

In the results of the experiments, it is clear that the alternating current resistances Rac of the samples S3 to S7 at the measured frequencies (2 MHz and 4 MHz) are lower than those of samples S1 and S2. This indicates that concentration of lines of magnetic force around corners of conductors located in end portions of the coil is suppressed and that as a result magnetic saturation is suppressed in the samples S3 to S7, which correspond to the embodiment and modifications.

Other Embodiments

The inductor according to the present disclosure is not limited to the inductor of the embodiment and can be modified within the scope of the gist of the disclosure. For example, the number of turns and the number of layers of the coil, the shape of the insulator layers and so forth may be appropriately chosen. In addition, the embodiment and modifications may be combined with one another.

As has been described above, the present disclosure is of use in inductors and is excellent in that an increase in alternating current resistance in an inductor including a magnetic material and a non-magnetic material can be suppressed.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a body composed of a magnetic material and a non-magnetic material; and a helical-shaped coil located inside the body;

wherein an inner circumferential surface of the coil is covered by the non-magnetic material, and in an orthogonal direction that is orthogonal to a central axis direction, which is a direction in which a central axis of the coil extends, and that is orthogonal to an advancement direction of a conductor that forms the coil, a sum of a width of the conductor and a width of the non-magnetic material covering an inner circumferential side of the conductor increases gradually from a minimum at an end portion of the coil on one side in the central axis direction to a maximum at a center portion of the coil in the central axis direction, wherein a sum of a width of the conductor and a width of the non-magnetic material covering an inner circumferential side of the conductor increases linearly or as a smooth curve from a minimum at an end portion of the coil on one side in the central axis direction to a maximum at a center portion of the coil in the central axis direction.

2. The inductor according to claim 1, wherein, in the orthogonal direction, the sum of the width of the conductor and the width of the non-magnetic material covering the inner circumferential side of the conductor becomes larger in a direction from the end portion of the coil on the one side in the central axis direction toward the center portion.

3. The inductor according to claim 1, wherein the sum of the width of the conductor and the width of the non-magnetic material covering the inner circumferential side of the conductor in the center portion of the coil in the central axis direction is larger than a sum of a width of the conductor and a width of the non-magnetic material covering an inner circumferential side of the conductor in an end portion of the coil on another side in the central axis direction.

4. The inductor according to claim 3, wherein, in the orthogonal direction, the sum of the width of the conductor and the width of the non-magnetic material covering the inner circumferential side of the conductor becomes larger in a direction from the end portion of the coil on the other side in the central axis direction toward the center portion.

5. The inductor according to claim 1, wherein the body includes non-magnetic material layers and magnetic material layers stacked on top of one another, and the non-magnetic material layers are provided around an inner circumference of the coil and are orthogonal to the central axis in a vicinity of the center portion in the central axis direction.

6. The inductor according to claim 1, wherein an outer circumferential surface of the coil is covered by the non-magnetic material, and in the orthogonal direction, a sum of a width of the conductor and a width of the non-magnetic material covering an outer circumferential side of the conductor in the center portion of the coil in the central axis direction is larger than a sum of a width of the conductor and a width of the non-magnetic material covering an outer circumferential side of the conductor in the end portion of the coil on the one side in the central axis direction.

7. The inductor as recited in claim 1, wherein the sum of a width of the conductor and a width of the non-magnetic material covering an inner circumferential side of the conductor forms a substantially circular arc.

8. The inductor as recited in claim 7, wherein the center portion that connects the end portions to each other has a shape that is substantially parallel to orthogonal direction.

9. The inductor as recited in claim 1, wherein the sum of a width of the conductor and a width of the non-magnetic material covering an inner circumferential side of the conductor forms a triangular shape with a center portion of the coil in the orthogonal direction being an apex.

10. The inductor as recited in claim 9, wherein an additional non-magnetic material layer is provided in the vicinity of a center portion of the coil.

11. The inductor as recited in claim 9, wherein the sum of a width of the conductor and a width of the non-magnetic material covering an outer circumferential side of the conductor forms a triangular shape with a center portion of the coil in the orthogonal direction being an apex.

* * * * *